United States Patent [19]

Tabler

[11] Patent Number: 4,522,729

[45] Date of Patent: Jun. 11, 1985

[54] FILTRATION OF OIL

[75] Inventor: Donald C. Tabler, Bartlesville, Okla.

[73] Assignee: Phillips Petroleum Company, Bartlesville, Okla.

[21] Appl. No.: 635,855

[22] Filed: Jul. 30, 1984

[51] Int. Cl.[3] ..... B01D 37/00; C10M 11/00

[52] U.S. Cl. ..... 210/727; 210/729; 208/180; 208/181

[58] Field of Search ..... 208/180–182, 208/251 R, 251 H, 289; 210/727–729, 778

[56] References Cited

U.S. PATENT DOCUMENTS

| | | | |
|---|---|---|---|
| 2,609,931 | 9/1952 | Rodman et al. | 210/62 |
| 3,489,676 | 1/1970 | Hu et al. | 208/179 |
| 3,523,074 | 8/1970 | Geger | 208/179 |
| 3,634,243 | 1/1972 | Wessels et al. | 252/34.7 |
| 3,778,371 | 12/1973 | Malec | 252/34 |
| 4,247,389 | 1/1981 | Johnson et al. | 208/181 |
| 4,248,719 | 2/1981 | Chafetz et al. | 252/34 |
| 4,251,380 | 2/1981 | Hammond et al. | 252/34 |
| 4,253,980 | 3/1981 | Hammond et al. | 252/34 |
| 4,265,733 | 5/1981 | Tabler et al. | 208/179 |
| 4,273,663 | 6/1981 | Hammond et al. | 252/34 |
| 4,287,049 | 9/1981 | Tabler et al. | 208/180 |
| 4,326,973 | 4/1982 | Hammond et al. | 252/34 |
| 4,338,206 | 7/1982 | Hammond et al. | 252/34 |
| 4,339,336 | 7/1982 | Hammond et al. | 252/34 |
| 4,376,040 | 3/1983 | Sader | 208/180 |
| 4,420,389 | 12/1983 | Beckworth et al. | 208/179 X |

*Primary Examiner*—Thomas Wyse

[57] ABSTRACT

Oil containing solid impurities is contacted with a tetraalkylammonium salt wherein the alkyl groups have from 1 to 6 carbon atoms, preferably from 2 to 5 carbon atoms, and solid impurities are then removed from the thus treated oil by filtration.

17 Claims, 1 Drawing Figure

FILTRATION OF OIL

Figure 1:
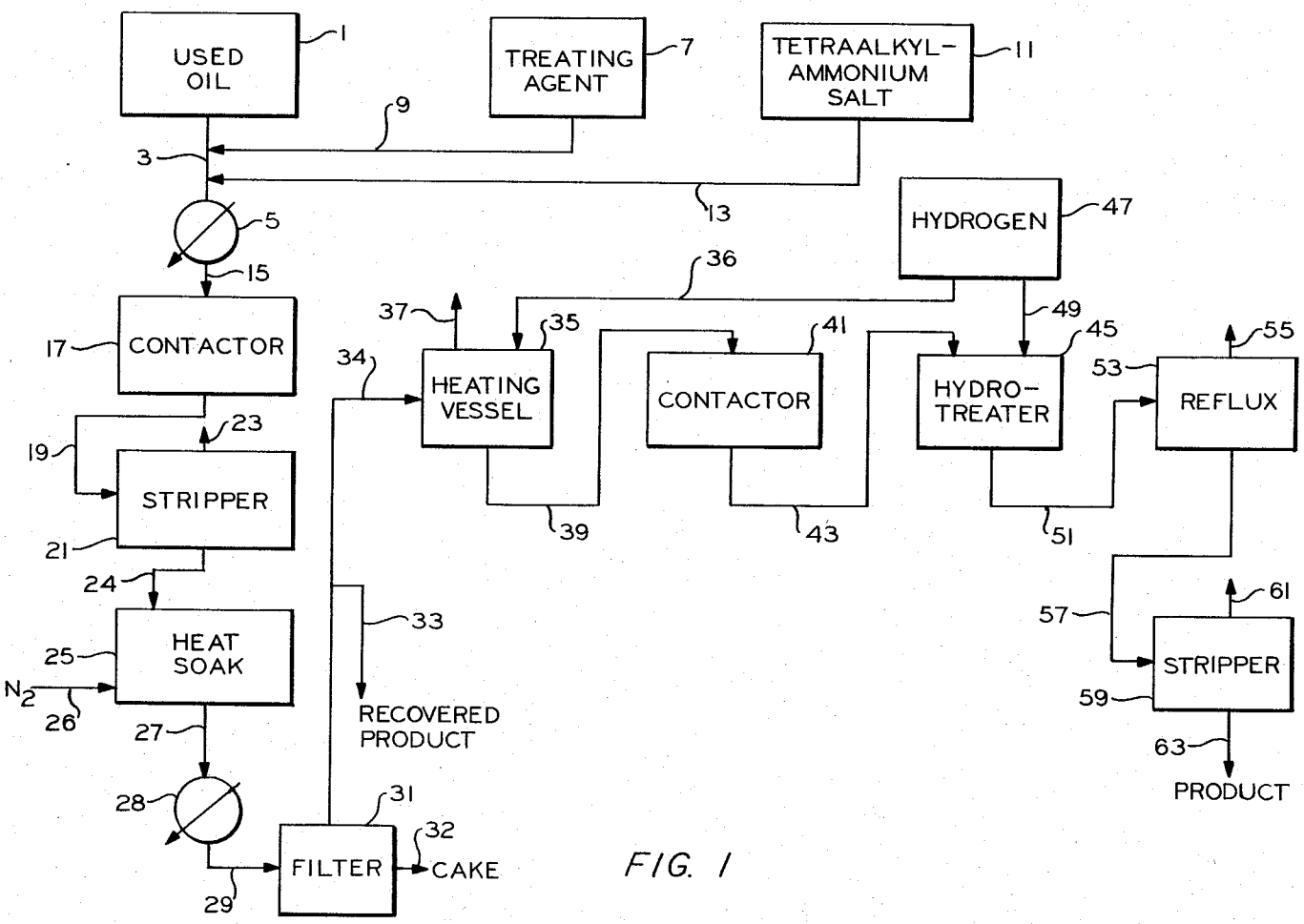

This invention relates to a method of filtering solid materials from oil.

In one of its aspects the invention relates to the removal of impurities from used lubricating oils. In another of its aspects the invention relates to the removal of soot particles from lubricating oil used in diesel engines. In another aspect the invention relates to the treatment of used lubricating oil to provide a purified oil suitable for use as fuel oil, in grease formulations, or as lube oil stock.

In recent years the performance of lubricating oils has been greatly improved by the addition of a number of compounds, such as detergents, pour point depressants, oxidation inhibitors and viscosity index improvers. The purpose of using modern detergent additives, such as calcium and barium salts of alkyl benzene sulfonic acids and ashless type detergents such as alkyl-substituted succinimides, is to suspend the resins that normally form in oil while in use as well as carbon, dirt, wear metal particles and other impurities in the oil in the engine so that these suspended impurities remain with the oil when the oil is drained from the engine during oil changes.

The presence of suspended impurities and the engine additives has greatly increased the task of reclaiming the used engine oils. The problem is accentuated by the presence of used lubricating oils from diesel engines. Since service stations generally place all crank case drainings into a common tank, practically all used lubricating oil available for re-refining or reclaiming processes has not only high-detergency properties, but also contains crank case drainings from diesel engines. The used diesel engine lubricating oils are particularly difficult to filter after treatment which precipitates many impurities from the used oils. This is probably because of higher levels of very fine particles of carbon or soot in used diesel engine lubricating oils than normally found in used lubricating oils from gasoline engines. The presence of dispersants normally found in lubricating oils hinders the agglomeration of such soot particles.

It is, therefore, an object of this invention to provide a process for improving the filtration of impurities from oils.

It is another object of the invention to provide an improved process for treating used lubricating oils from diesel engines.

It is another object of the invention to provide improved filtration in an integrated process for reclaiming a high-purity lube oil stock from used lubricating oils.

Other aspects, objects, and the advantages of this invention will be apparent to one skilled in the art upon studying this disclosure, the appended claims and the drawing which is a schematic representation of a process in accordance with the invention.

In accordance with this invention an oil containing solid impurities is contacted with a tetraalkylammonium salt wherein the alkyl groups have from 1 to 6 carbon atoms, preferably from 2 to 5 carbon atoms, and solid impurities are then removed from the thus treated oil by filtration.

In a particular embodiment of the invention, a used lubricating oil is contacted with an aqueous solution of an ammonium salt treating agent at conditions of temperature and pressure sufficient to allow reaction of the treating agent with ash-forming contaminants of the oil, thereby producing a precipitate of reacted contaminants. At least one tetraalkylammonium salt, having from 1 to 6 carbon atoms in each alkyl group, is added to the oil prior to, with, or subsequent to the addition of the ammonium salt treating agent. The treated oil containing the tetraalkylammonium salt is subjected to filtration to remove solid materials from the oil.

The used lubricating oils treated by the process of this invention are primarily the discarded oils that have been used for internal combustion lubrication purposes such as crankcase oils, e.g., in gasoline engines or diesel engines. Other sources of used oils include steam turbine oils, transmission and gear oils, steam engine oils, hydraulic oils, heat transfer oils and the like, and mixtures thereof. The oils used for these purposes are generally refined lubricating cuts from paraffin-base, mixed-base, or naphthenic crudes. Their viscosities are generally in the range of about 100 to about 1800 SUS at 100° F. The oils also contain various additives such as oxidation inhibitors (e.g., barium, calcium and zinc alkyl thiophosphates, di-t-butyl-p-cresol, etc.), antiwear agents (e.g., organic lead compounds such as lead diorganophosphorodithioates, zinc dialkyldithiophosphates, etc.), rust inhibitors (e.g., calcium and sodium sulfonates, etc.), dispersants (e.g., calcium and barium sulfonates and phenoxides, etc.), viscosity index improvers (e.g., polyisobutylene, poly(alkylstyrenes), etc.), detergents (e.g., calcium and barium salts of alkyl benzene sulfonic acids), and ashless type detergents (e.g., alkyl-substituted succinimides, etc.).

The ammonium salt treating agents which are useful in the process of the present invention are those selected from the group consisting of ammonium sulfate, ammonium bisulfate, ammonium phosphate, diammonium hydrogen phosphate, ammonium dihydrogen phosphate, ammonium thiosulfate, ammonium polyphosphates, such as ammonium metaphosphate, urea sulfate, guanidine sulfate, urea phosphate, and guanidine phosphate, and mixtures thereof. Said treating agents can be formed in situ if desired as, for example, by combining ammonia and/or ammonium hydroxide with sulfuric acid and/or phosphoric acid and/or an ammonium hydrogen sulfate or phosphate, i.e., ammonium bisulfate, diammonium hydrogen phosphate, and/or ammonium dihydrogen phosphate. When the treating agent is formed in situ, the reactants employed can be introduced at the same time, or one after the other.

Although the concentration of the treating agent in the aqueous solution of treating agent is not critical and more dilute solutions can be used, the economics of the process are enhanced by the use of relatively concentrated solutions in order that the amount of water to be removed subsequently will not be great. Generally the concentration of treating agent in the aqueous solution will be within the range of about 30 to about 95 weight percent, typically about 80 weight percent, of that in an aqueous solution at 25° C. saturated with the treating agent. Frequently some water will be found in used oil, and in these instances the concentration of the treating agent can be adjusted accordingly. If desired, water entrained in the untreated used lubricating oil can be removed before use of the oil in the process of this invention. Such a separation can be readily achieved by removal of the water phase which may occur in the storage tanks used for the used lubricating oil.

The treating agent should be employed in an amount at least sufficient to react with all of the metal constituents in the used oil. Although the weight ratio of the treating agent to the used oil can vary greatly, depending in part upon the nature and concentration of metal-containing components in the used oil and on the particular treating agent employed, it generally will be within the range of about 0.002:1 to about 0.05:1, most often being within the range of about 0.005:1 to about 0.015:1, and typically being about 0.01:1. Although larger amounts of treating agent can be used, in most instances this would be wasteful of treating agent.

The used oil can be contacted with the treating agent under any conditions suitable for the reaction of the treating agent with ash-forming contaminants of the used oil to produce a precipitate of reacted contaminants. Presently preferred pressures are within the range of atmospheric pressure to about 250 psia, while presently preferred temperatures are in the range of about 60° C. to about 200° C. The contacting will preferably occur for a time in the range of about 10 minutes to about 2 hours. Typical conditions include a temperature of about 100° C., a pressure of about 20 psia, and a contact time of about 30 minutes.

In accordance with the invention at least one tetraalkylammonium salt, each alkyl group having from 1 to 6 carbon atoms, is added to the used oil prior to filtration for the removal of solid materials from the oil. The tetraalklyammonium salt can be added to the used oil prior to or simultaneously with the treatment of the used oil with the ammonium salt treating agent. However, it is presently preferred to add the tetraalkylammonium salt to the used oil simultaneously with the treatment of the used oil with the ammonium salt treating agent.

Suitable tetraalkylammonium salts are those representable by the formula:

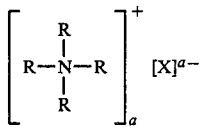

wherein the R groups may be the same or different from each other, each R being an alkyl group having from 1 to 6 carbon atoms, X is a monovalent or multivalent organic or inorganic anion, and a is the valence of X. Suitable organic anions include monovalent or multivalent anions of organic acids having from 1 to 8 carbon atoms. Suitable inorganic anions include halides (e.g., chloride, bromide, iodide, etc.), phosphate, sulfate, nitrite, nitrate, and the like. Specific suitable tetraalkylammonium salts include tetramethylammonium bromide, tetramethylammonium chloride, tetramethylammonium phosphate, tetraethylammonium chloride, tetraethylammonium bromide, tetraethylammonium sulfate, tetrapropylammonium bromide, tetrapropylammonium chloride, tetrapropylammonium phosphate, tetrapropylammonium benzoate, tetra-n-butylammonium bromide, tetra-n-butylammonium chloride, tetra-n-butylammonium benzoate, tetra-n-butylammonium phosphate, tetra-n-butylammonium sulfate, tetra-n-butylammonium nitrite, tetra-n-butylammonium nitrate, tetra-n-butylammonium acetate, tetraisobutylammonium bromide, tetraisobutylammonium chloride, tetraisobutylammonium phosphate, tetraisobutylammonium acetate, tetraisobutylammonium benzoate, tetra-n-pentylammonium bromide, tetra-n-pentylammonium chloride, tetra-n-pentylammonium acetate, tetra-n-pentylammonium phosphate, tetra-n-pentylammonium benzoate, tetra-n-pentylammonium sulfate, tetra-n-hexylammonium bromide, tetra-n-hexylammonium chloride, tetra-n-hexylammonium phosphate, tetra-n-hexylammonium acetate, tetra-n-hexylammonium benzoate, ethyltrimethylammonium bromide, diethyldibutylammonium bromide, propyltributylammonium benzoate, and the like, and mixtures of any two or more thereof.

The tetraalkylammonium salt can be employed in any amount which is suitable to improve the filtration of the solid materials from the treated oil. In general the tetraalkylammonium salt will be employed in an amount in the range of about 0.02 to about 2 weight percent, based on the weight of the used oil. Presently preferred amounts of the tetraalkylammonium salt utilized in the invention are in the range of about 0.03 to about 1.5 weight percent of the used oil, with the more preferred amounts being in the range of about 0.05 to about 1 weight percent of the used oil.

Water can be removed by any suitable means from the mixture resulting from the combination of the used oil and the aqueous solution of the treating agent. Distillation is the preferred method of removing water. Generally, the distillation is carried out at a temperature in the range of about 100° to about 140° C. and a pressure in the range of about 5 to about 25 psig for a period of time sufficient to effect removal of a major portion of the water. Light hydrocarbons contained in the oil that boil under the distillation conditions, e.g., gasoline, can be separated from the oil along with the water.

In a presently preferred embodiment the mixture of used oil, treating agent and tetraalkylammonium salt is subjected to a heat soak step prior to filtration of solids from the treated oil. This heat soak step can be accomplished by heating at least a portion of the mixture to a temperature in the range of about 320° to about 420° C. for a period of time sufficient to decompose at least a portion of any ammonium salts of sulfonic acid and dialkyldithiophosphoric acid that are contained therein. The time for which the mixture is maintained at the heat soak temperatures will generally be in the range of about 5 minutes to about 2 hours. Presently preferred heat soak conditions include a temperature in the range of about 340° to about 370° C. for a time in the range of about 15 minutes to about 60 minutes. The thus treated mixture can then be cooled to a suitable lower temperature, e.g. in the range of about 100° to about 180° C., for the filtration operation. Additional information on the heat soak treatment can be found in U.S. Pat. No. 4,247,389.

While the invention can be employed in many environments wherein solid materials are to be filtered from oils, it will be described in terms of a process for treatment of used lubricating oils to recover a lube oil stock. Processes of this type are disclosed in various patents, including U.S. Pat. Nos. 4,151,072, 4,247,389, 4,248,719, and 4,287,049, the disclosures of which are incorporated herein by reference.

Referring now to FIG. 1 of the drawings, used oil from storage tank 1 is passed through line 3 to heater 5. Aqueous treating agent, preferably diammonium hydrogen phosphate, is passed from storage tank 7 through line 9 in an amount in slight excess of that required to react with the ashforming constituents in the used oil, into admixture with the oil in line 3. At least one tetraalkylammonium salt is passed from storage tank 11 through line 13 into admixture with the used oil and treating agent in line 3. After the admixture is heated in heater 5, the resulting hot mixture of oil, tetraalkylammonium salt, and treating agent is passed by line 15 into contactor 17. In the contactor 17 sufficient agitation is provided, as with paddles or other mixing means, to assure thorough dispersion of the aqueous treating agent and the tetraalkylammonium salt into the oil phase. It is also within the concept of this invention to add the relatively small amounts of treating agent and tetraalkylammonium salt to the used oil either downstream of the heater 5 into conduit 15 or directly into the contactor 17.

The admixture of used oil, tetraalkylammonium salt, and aqueous treating agent is maintained in contactor 17 at conditions of temperature and pressure for a period of time sufficient to effect reaction of the treating agent with essentially all of the ash-forming components present in the used oil.

After the ash-forming components in the hot oil have been adequately reacted with a treating agent, the reaction mass, which has a continuous oil phase, is passed via conduit 19 into stripper 21. In an embodiment of the invention, the upper end of stripper 21 is maintained at a temperature and pressure that allows the removal through line 23 of water and light hydrocarbons from the mixture on controlled boiling. These components can be passed to a phase separator (not shown) wherein a hydrocarbon layer and a water layer are allowed to separate with subsequent transfer of material from these layers to separate storage.

A residual mixture having a sulfated ash value in the range of about 0.3 to about 10 weight percent (ASTM D 847-72) and which comprises a hot oil phase, which is essentially free of water but which has excess treating agent, and a residual water phase is passed downwardly through the stripper 21. In the stripper, while not required, it is preferred to maintain the oil at an elevated temperature while steam is introduced to assist in removal of light components and residual water from the system. Thereafter the resulting stripped hot oil is passed through line 24 to heat soak vessel 25.

In the heat soak vessel 25 the mixture of used oil, treating agent and tetraalkylammonium salt is subjected to a heat soak step prior to filtration of solids from the treated oil. The purpose of this heat soak treatment is to produce a product which when later filtered will contain less ash than it would have contained if it had not been subjected to the heat soak treatment. The heat soak treatment can be accomplished by maintaining the mixture at temperatures in the range of about 320° to about 420° C. for an average residence time in the range of about 5 minutes to about 2 hours. Nitrogen can be passed through conduit 26 into heat soak vessel 25 in order to provide a flowing nitrogen purge to minimize oxidation of the oil. The thus treated mixture can then be passed through conduit 27 and heat exchanger 28 to cool the mixture to a suitable lower filteration temperature. The thus cooled mixture can then be passed through conduit 29 to filter 31 to remove suspended and entrained ash-forming materials.

Although a filter aid can be added to the residual mixture prior to stripping to assist in the subsequent separation of solids from the essentially water-free oil phase, it is preferable that the filter 31 be precoated with a suitable filter aid. Presently preferred filter aids include diatomaceous earth, perlite, and cellulose fibers, and mixtures thereof. The presently most preferred filter aid is diatomaceous earth. In addition to precoating the filter, it is desirable to incorporate filter aid into the oil at a point downstream of the stripper 21 and upstream of the filter 31.

In the presently preferred embodiment of the invention, filter cake is removed by line 32 for further treatment. Filtered oil, essentially free of ash-forming constituents, i.e., now having a sulfated ash value in the range of about 0.01 to about 0.05 weight percent (ASTM D 847-72) exclusive of excess treating agent or any filter aid which might have passed through the filter, can be removed through line 33 as recovered product without further treatment. Used oil at this point in an overall treating system can be used as a fuel oil, in grease formulations or in the preparation of some types of lubricating oil formulations.

It is presently preferred, however, to further treat the oil product by the process of U.S. Pat. No. 4,151,072. The hot oil following filtration is passed via line 34 to heater 35 to heat the oil to a temperature in the range of about 200° C. to about 480° C. If desired, a first portion of hydrogen can be added thereto by means of line 36. The resulting hot oil having added hydrogen therein is then passed through line 39 to contactor 41 wherein decomposition of the sulfonates contained in the oil is effected.

While it presently preferred that contactor 41 contain bauxite or an activated carbon adsorbent bed therein, this unit can employ other adsorbents such as silica gel, clay, activated alumina, and mixtures thereof, and the like. The adsorbent serves to effect breakdown and decomposition of the ammonium salts of sulfonic acids and the ashless detergents contained in the oil. The adsorbent further serves to collect a small portion of the resulting products and thus precludes passage of such undesirable decomposition products to the hydrotreater. Such adsorbents can be regenerated by conventional means and reused.

While less preferred, it is also possible to omit contactor 41 and to remove the small amount of ash components and highly polar materials present in the low-ash, filtered oil by heating the oil to a temperature within the range of about 300° to about 410° C., e.g., about 380° C., in the presence of hydrogen and an adsorbent suspended in the oil. After such treatment, the oil is cooled to a temperature within the range of about 60° to about 200° C., e.g., about 150° C., and refiltered. The same adsorbents cited above for use in fixed contactors are suitable for this contact-treating process and give similar results.

Preferably, the adsorbent contains about 0.2 to about 20 weight percent of at least one metal selected from the group consisting of Group VIB and Group VIII metals, this weight percent being based on the total weight of modified adsorbent. This modified adsorbent can be and often preferably is prepared by impregnation of the adsorbent with an aqueous solution of a water-soluble compound of a Group VIB or Group VIII metal, followed by evaporation of water. Water-soluble compounds presently preferred for this use are iron compounds such as ferric ammonium oxalate, ferric ammonium citrate, ferric sulfate, and ferrous ammonium sulfate.

The resulting treated oil is thereafter passed from contactor 41 via line 43 to hydrotreater 45, which is maintained at an elevated temperature. This serves to effect destruction of various additive systems previously added to the original oil stocks. Hydrogen from source 47 for the desired hydrotreating reaction is introduced to the system by means of line 36 or, if desired, by line 49 directly to the hydrotreater 45.

In hydrotreater 45 the oil is subjected to hydrogenation conditions in the presence of catalyst sufficient to remove unwanted compounds and unsaturated materials and to effect decomposition of residual sulfur, oxygen and nitrogen bodies so as to yield an oil product suitable for further purification to a lube stock.

Suitable catalyst for use in hydrotreater 45 are those selected from the group consisting of Group VIB and Group VIII metals and combinations thereof, on a refractory support, used in conventional hydrodesulfurization processes.

Following hydrotreating, the resulting oil is passed by means of conduit 51 to separator-reflux column 53 which serves to remove water and various other by-products of the previous treatments. If desired, and particularly when HCl is present, water can be injected into column 53 to aid in removal of most of any HCl and part of the $H_2S$ and $NH_3$ as water-soluble salts such as ammonium chloride and ammonium sulfides. Overhead from column 53 comprising hydrogen, $H_2S$, $NH_3$, vaporized lube oil and fuel fraction, and water is passed by means of line 55 to further treatment such as sulfur removal and lube oil and fuel fraction recovery (not shown). Resulting sulfur-free hydrogen can thereafter be passed to ammonia removal, for example by water washing in an ammonia removal unit (not shown) and recycled.

The bottoms product from column 53 is passed via line 57 to lubestock stripper 59, wherein a further steam treatment is carried out.

Stripping, preferably steam stripping, of the oil is essential to the integrated process of this invention since it serves to remove those light hydrocarbon products boiling below the oil, such as kerosene or heavy gasoline, which have remained entrained in the oil or which are by-products of the hydrogenation treatment. Alternatively, gas stripping such as with hydrogen can be employed.

The resulting hot stripped product, consisting essentially of a pure lube oil stock, following cooling, is thereafter passed by means of line 63 to a lube oil stock product tank (not shown) for storage and subsequent use as an additive-free lube oil stock suitable for reformulation with additives as desired.

Overhead from stripper 59, which consists essentially of fuel oil and water, can be passed by means of line 61 to a settler (not shown) where a hydrocarbon layer and a water layer are allowed to form. The hydrocarbon layer is removed and combined, if desired, with the hydrocarbon phase produced from the overhead in line 23.

The following examples illustrate the improvement in filtration rate with addition of a tetraalkylammonium compound in accordance with the invention.

EXAMPLE I

A 100 g quantity of used lubricating oil obtained from Bandeirante Co. of Brazil was placed in a 250 mL beaker and heated, with stirring, to 200° F. (93° C.). About 1.1 grams of diammonium hydrogen phosphate (DAP) were dissolved in 10 mL of water and the resulting solution at a temperature of 200° F. was mixed with the 200° F. used oil. The resulting mixture was heated slowly to 250° F. to distill off water, and then the heating was continued until the mixture reached 300° F. At this point 1 gram of Eagle Pitcher FP-4 filter-aid was added to the mixture, and the heating was continued until the temperature of the resulting mixture reached 350° F. The mixture was then filtered through a precoated 6 cm Buchner funnel in which filter paper was covered with 5 additional grams of FP-4 filter aid. The filter rate was measured and determined to be 1.9 gal/hr/ft$^2$.

EXAMPLE II

The procedure of Example I was followed except that simultaneously with the addition of the DAP a 4 mL solution of 5.5 wt % tetrahexyl ammonium chloride in mixed xylenes solvent was also added. The filtration rate was found to be 4.2 gal/hr/ft$^2$.

EXAMPLE III

A 100 g quantity of used lubricating oil obtained from Bandeirante Co. of Brazil was placed in a 250 mL beaker and heated, with stirring, to 200° F. (93° C.). About 1.1 grams of diammonium hydrogen phosphate (DAP) were dissolved in 10 mL of water and the resulting solution at a temperature of 200° F. was mixed with the 200° F. used oil. The resulting mixture was heated slowly to 250° F. to distill off water, and then heated faster to 350° F. to remove hydrocarbon volatiles. At this point the mixture was transferred to a 250 mL flask in order to conduct a heat soak treatment under a flowing nitrogen purge to avoid oxidation of the oil. Heating of the mixture was continued until the temperature of the mixture reached 650° F. and then the temperature was held there (±10° F.) for 1 hour. Then the mixture was cooled to 400° F., at which point the nitrogen purge was discontinued and 1 gram of Eagle Pitcher FP-4 filter aid was added to the mixture. The resulting mixture was further cooled to 350° F. and the thus cooled mixture was then filtered through a precoated Buchner funnel as in Example I. The filtration rate was measured to be 3.0 gal/hr/ft$^2$.

EXAMPLE IV

The procedure of Example III was followed except that, simultaneously with the addition of the DAP, 4 mL of a mixed xylene solution containing 5.5 wt % of tetrahexylammonium chloride was also added. The filtration rate was 6.2 gal/hr/ft$^2$.

EXAMPLE V

A 100 g quantity of used lubricating oil from Mexico was put into a 250 mL beaker and heated, with stirring, to 200° F. (93° C.). Then a solution of about 0.82 gram of DAP dissolved in 3 mL of water was mixed at 200° F. with the oil at 200° F. The resulting mixture was heated slowly to 250° F. to remove water and then heated faster to 350° F. to remove hydrocarbon volatiles. At this point the mixture was transferred to a 250 mL flask under a flowing nitrogen purge to avoid oxidation of the oil. Heating was continued until the temperature of the mixture reached 650° F. and then the mixture temperature was held there (±10° F.) for 1 hour. Then the mixture was cooled to 400° F., at which point the nitrogen purge was discontinued and 1 gram of Eagle Pitcher FP-4 filter aid was added to the mixture. The mixture was further cooled to 350° F. and then filtered as in Example I. The measured filtration rate was 9.4 gal/hr/ft$^2$.

EXAMPLE VI

The procedure of Example V was followed except that, simultaneously with the addition of the DAP, 10 mL of a solution containing 5.0 wt % of tetrabutyl ammonium phosphate in distilled water (tetrabutyl and lower carbon number compounds were not soluble in mixed xylenes) was added. The filtration rate was 29.1 gal/hr/ft$^2$, a significant increase over the 9.4 gal/hr/ft$^2$ filtration rate of Example V.

Summary tables of the above and additional tests are as follows:

TABLE I

Filtration Rates Without Heat Soak Step with Bandeirante Oil

| Run[1] | Additive[2] | Concentration of Additive in oil, Wt % | Filtration Rate gal/hr/ft$^2$ |
|---|---|---|---|
| 1 | None | — | 1.9 |
| 2 | Tetrahexyl Ammonium Chloride | 0.01 | 1.8 |
| 3 | Tetrahexyl Ammonium Chloride | 0.05 | 2.3 |
| 4 | Tetrahexyl Ammonium Chloride | 0.10 | 3.2 |
| 5 | Tetrahexyl Ammonium Chloride | 0.20 | 4.2 |
| 6 | Tetrahexyl Ammonium Chloride | 0.11 | 2.1 |
| 7 | Tetrahexyl Ammonium Chloride | 0.16 | 3.0 |
| 8 | Tetrahexyl Ammonium Chloride | 0.22 | 4.2 |
| 9 | Tetrahexyl Ammonium Chloride | 0.28 | 3.3 |
| 10 | Tetrahexyl Ammonium Chloride | 0.44 | 3.4 |
| 11 | Tetrahexyl Ammonium Benzoate | 0.01 | 1.7 |
| 12 | Tetrahexyl Ammonium Benzoate | 0.05 | 2.8 |
| 13 | Tetrahexyl Ammonium Benzoate | 0.10 | 2.7 |
| 14 | Tetrahexyl Ammonium Benzoate | 0.20 | 3.2 |

[1]Runs 1 and 8 are Examples I and II. Runs 2 through 7 and 9 through 14 were made with the procedure of Example II except for the type and amount of additive.
[2]In runs 2 through 5 and 11 through 14 the additive was used in the form of a 1 wt % solution of the additive in the mixed xylenes solvent. In runs 6 through 10 the additive was used in the form a 5.5 wt % solution of the additive in the mixed xylenes solvent.

TABLE II

Filtration Rates With Heat Soak Step with Bandeirante Oil

| Run[1] | Additive[2] | Concentration of Additive in oil, Wt % | Filtration Rate gal/hr/ft$^2$ |
|---|---|---|---|
| 15 | None | — | 3.0 |
| 16 | Tetrahexyl Ammonium Chloride | 0.22 | 6.2 |
| 17 | Tetrabutyl Ammonium Phosphate | 0.1 | 3.5 |
| 18 | Tetrabutyl Ammonium Phosphate | 0.2 | 5.2 |
| 19 | Tetrabutyl Ammonium Phosphate | 0.3 | 6.2 |
| 20 | Tetrabutyl Ammonium Phosphate | 0.4 | 7.1 |
| 21 | Tetrabutyl Ammonium Phosphate | 0.5 | 8.1 |
| 22 | Tetrabutyl Ammonium Phosphate | 0.6 | 12.6 |

[1]Runs 15 and 19 are Examples III and IV. Runs 16 through 18 and 20 through 22 were made with the procedure of Example IV except for the type and amount of additive.
[2]In run 16 the additive was used in the form of a 5.5 wt % solution of the additive in the mixed xylenes solvent. In runs 17 through 22, the additive was used in the form of a 5.0 wt. % solution of the additive in distilled water.

TABLE III

Filtration Rates With Heat Soak Step with Mexican Oil

| Run[1] | Additive[2] | Concentration of Additive in oil, Wt % | Filtration Rate gal/hr/ft$^2$ |
|---|---|---|---|
| 23 | None | — | 9.4 |
| 24 | Tetraethylammonium Bromide | 0.1 | 18.1 |
| 25 | Tetraethylammonium Bromide | 0.25 | 19.0 |
| 26 | Tetraethylammonium Bromide | 0.5 | 18.1 |
| 27 | Tetrapropylammonium Bromide | 0.1 | 18.8 |
| 28 | Tetrapropylammonium Bromide | 0.25 | 22.5 |

TABLE III-continued

Filtration Rates With Heat Soak Step with Mexican Oil

| Run[1] | Additive[2] | Concentration of Additive in oil, Wt % | Filtration Rate gal/hr/ft$^2$ |
|---|---|---|---|
| 29 | Tetrapropylammonium Bromide | 0.5 | 21.9 |
| 30 | Tetrabutylammonium Bromide | 0.1 | 15.9 |
| 31 | Tetrabutylammonium Bromide | 0.25 | 24.9 |
| 32 | Tetrabutylammonium Bromide | 0.5 | 28.4 |
| 33 | Tetrabutylammonium Phosphate | 0.5 | 29.1 |
| 34 | Tetrapentylammonium Bromide | 0.1 | 15.0 |
| 35 | Tetrapentylammonium Bromide | 0.25 | 20.7 |
| 36 | Tetrapentylammonium Bromide | 0.5 | 23.4 |
| 37 | Tetrahexylammonium Benzoate | 0.5 | 19.3 |
| 38 | Tetramethylammonium chloride | 0.05 | 14.0 |
| 39 | Tetramethylammonium chloride | 0.1 | 14.0 |
| 40 | Tetramethylammonium chloride | 0.25 | 13.1 |
| 41 | Tetramethylammonium chloride | 0.5 | 18.7 |
| 42 | Tetrahexylammonium chloride[4] | 0.5 | 9.7 |
| 43 | Tetrahexylammonium chloride | 0.1 | 14.0 |
| 44 | Tetrahexylammonium chloride | 0.25 | 20.2 |
| 45 | Tetrahexylammonium chloride | 0.5 | 21.1 |
| 46 | Cetyltrimethylammonium Bromide | 0.1 | 12.3 |
| 47 | Cetyltrimethylammonium Bromide | 0.25 | 10.1 |
| 48 | Cetyltrimethylammonium Bromide | 0.5 | 10.2 |
| 49 | Cetylpyridinium chloride | 0.1 | 13.7 |
| 50 | Cetylpyridinium chloride | 0.25 | 12.5 |
| 51 | Cetylpyridinium chloride | 0.5 | 14.2 |
| 52 | Cetyldimethylethylammonium Bromide | 0.1 | 12.8 |
| 53 | Cetyldimethylethylammonium Bromide | 0.25 | 13.8 |
| 54 | Cetyldimethylethylammonium Bromide | 0.5 | 10.4 |
| 55 | Sucrose[3] | 0.05 | 15.7 |
| 56 | Sucrose[3] | 0.1 | 15.9 |
| 57 | Sucrose[3] | 0.25 | 16.3 |
| 58 | Sucrose[3] | 0.5 | 15.4 |
| 59 | Ethylene Glycol[3] | 0.5 | 12.1 |

[1]Runs 23 and 33 are Examples V and VI. Runs 24 through 32 and 34 through 58 were made with the procedure of Example IV except for the type and amount of additive.
[2]In runs 37 and 43 through 45 the additive was used in the form of a 5.0 wt % solution of the additive in the mixed xylenes solvent. In runs 24 through 36, 38 through 41, and 46 through 54, the additive was used in the form of a 5.0 wt % solution in distilled water.
[3]Runs 55 through 59 utilize additives disclosed in U.S. Pat. No. 4,287,049.
[4]It appears from the data of runs 42 through 45, as well as other data with this additive with the Bandeirante oil, that the data of run 42 are in error. The only apparent explanation is that run 42 was done without actually adding any additive.

A discussion of the significance of the preceding data now follows.

The data of Tables I, II and III show the effect on filtration rate of adding the tetraalkylammonium salt additives simultaneously with the demetallizing reagent. The test oil in Tables I and II was Bandeirante waste oil from Brazil. This appears to be entirely from diesel engines. In Table I the test was done without the heat-soak step (item 25 of the drawing), and in Table II, the test included the heat-soak step. As expected, the heat-soak step 25 without the additive increased the filtration rate somewhat. The use of the additives increased the filtration rate both with and without the heat-soak and the increase in filtration rate was approximately proportional to the concentration of the additive up to a certain concentration (where the ionic isoelectric point is reached). In the case without the heat-soak step (Table I) and using the tetrahexylammonium chloride additive, this concentration appeared to be between 0.22 and 0.28 wt. %. In the case with the heat-soak step included, and with tetrabutylammonium phosphate additive, the ionic isoelectric point concentration was not found up to 0.6 wt. % of the additive. That is, in this case, the filtration rate continued to increase as the concentration of additive was increased. Albeit, in general, there is an upper limit in additive concentration beyond which filtration rates decrease.

The data of Table III show the effect of several different additives at several concentrations on the filtration rate in processing a sample of waste oil from Mexico. This waste oil sample appears to be a blend of waste oils from several sources including drainings from both gasoline engines and diesel engines. The heat-soak step 25 was used in all of the runs of this table.

As in the previous tables, the data of Table III show that the use of any of the tested additives increased the filtration rate to some extent. In addition, in Table III, a large number of additives were studied, and some differences between additives became apparent. Overall, the tetramethylammonium through tetrahexylammonium salts were effective in increasing the filtration rates, with the tetrabutylammonium salts giving the greatest improvement. The tetramethylammonium and tetrahexylammonium salts were somewhat less effective, but still gave definite improvements. Conversely, three other additives having larger alkyl groups gave significantly less improvement in the filtration rates. These additives were cetyltrimethylammonium bromide (run 46–48), cetylpyridinium chloride (runs 49–51) and cetyldimethylethylammonium bromide (runs 52–54).

The additives of runs 55 through 59 are polyhydroxy compounds which were disclosed in U.S. Pat. No. 4,287,049. They are included in this table as comparisons.

I claim:

1. In a process for removing ash-forming contaminants from a used oil by mixing said used oil with an aqueous solution of an ammonium salt treating agent at conditions of temperature and pressure sufficient for reaction of the treating agent with the contaminants in the used oil to form a precipitate of reacted contaminants, the improvement which comprises contacting the mixture with at least one tetraalkylammonium salt representable by the formula:

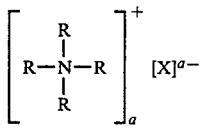

wherein the R groups may be the same or different from each other, each R being an alkyl group having from 1 to 6 carbon atoms, and X is an organic or inorganic anion, and a is the valence of X, the amount of said at least one tetraalkylammonium salt being suitable to improve the filtration of solid materials from the thus treated used oil, and subjecting the resulting mixture to filtration to remove solid materials from the used oil.

2. A process in accordance with claim 1 wherein X is selected from the group consisting of monovalent or multivalent anions of organic acids having from 1 to 8 carbon atoms, halides, phosphate, sulfate, nitrite, and nitrate.

3. A process in accordance with claim 1 wherein the amount of said at least one tetraalkylammonium salt is in the range of about 0.02 to about 2 weight percent, based on the weight of the used oil.

4. A process in accordance with claim 3 wherein X is selected from the group consisting of monovalent or multivalent anions of organic acids having from 1 to 8 carbon atoms, halides, phosphate, sulfate, nitrite, and nitrate.

5. A process in accordance with claim 1 wherein said at least one tetraalkylammonium compound is selected from the group consisting of tetramethylammonium bromide, tetramethylammonium chloride, tetramethylammonium phosphate, tetraethylammonium chloride, tetraethylammonium bromide, tetraethylammonium sulfate, tetrapropylammonium bromide, tetrapropylammonium chloride, tetrapropylammonium phosphate, tetrapropylammonium benzoate, tetra-n-butylammonium bromide, tetra-n-butylammonium chloride, tetra-n-butylammonium benzoate, tetra-n-butylammonium phosphate, tetra-n-butylammonium sulfate, tetra-n-butylammonium nitrite, tetra-n-butylammonium nitrate, tetra-n-butylammonium acetate, tetraisobutylammonium bromide, tetraisobutylammonium chloride, tetraisobutylammonium phosphate, tetraisobutylammonium acetate, tetraisobutylammonium benzoate, tetra-n-pentylammonium bromide, tetra-n-pentylammonium chloride, tetra-n-pentylammonium acetate, tetra-n-pentylammonium phosphate, tetra-n-pentylammonium benzoate, tetra-n-pentylammonium sulfate, tetra-n-hexylammonium bromide, tetra-n-hexylammonium chloride, tetra-n-hexylammonium phosphate, tetra-n-hexylammonium acetate, tetra-n-hexylammonium benzoate, ethyltrimethylammonium bromide, diethyldibutylammonium bromide, propyltributylammonium benzoate, and mixtures of any two or more thereof.

6. A process in accordance with claim 5 wherein the amount of the tetraalkylammonium salt utilized is in the range of about 0.05 to about 1 weight percent of the used oil.

7. A process in accordance with claim 1 wherein the tetraalkylammonium salt is added to the used oil prior to or substantially simultaneously with the addition of the ammonium salt treating agent.

8. A process in accordance with claim 1 wherein the tetraalkylammonium salt is added to the used oil after the contact of the used oil with the ammonium salt treating agent has caused the formation of the precipitate of reacted contaminants.

9. A process in accordance with claim 1 wherein the admixture of used oil, treating agent, and tetraalkylammonium salt is subjected to a heat-soak treatment prior to said filtration.

10. A process in accordance with claim 9 wherein said heat-soak treatment comprising maintaining said admixture at temperatures in the range of about 320° to about 420° C. for an average residence time in the range of about 5 minutes to about 2 hours.

11. A process in accordance with claim 1 wherein each R is an alkyl group having from 2 to 5 carbon atoms.

12. A process for improving the filtration rate of an oil containing very fine solid materials which comprises admixing the oil with at least one tetraalkylammonium salt representable by the formula:

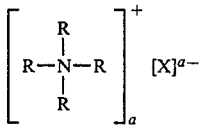

wherein the R groups may be the same or different from each other, each R being an alkyl group having from 1 to 6 carbon atoms, X is a monovalent or multivalent organic or inorganic anion, and a is the valence of X, the amount of said at least one tetraalkylammonium salt being suitable to improve the filtration of the solid materials from the thus treated oil, and subjecting the resulting mixture to filtration to remove solid materials from the oil.

13. A process in accordance with claim 12 wherein X is selected from the group consisting of monovalent or multivalent anions of organic acids having from 1 to 8 carbon atoms, halides, phosphate, sulfate, nitrite, and nitrate.

14. A process in accordance with claim 12 wherein the amount of said at least one tetraalkylammonium salt is in the range of about 0.02 to about 2 weight percent, based on the weight of the oil with which said salt is admixed.

15. A process in accordance with claim 14 wherein X is selected from the group consisting of monovalent or multivalent anions of organic acids having from 1 to 8 carbon atoms, halides, phosphate, sulfate, nitrite, and nitrate.

16. A process in accordance with claim 12 wherein each R is an alkyl group having 2 to 5 carbon atoms.

17. A process in accordance with claim 16 wherein the R groups in a tetraalkylammonium salt are the same.

* * * * *